US005529683A

United States Patent [19]

Critz et al.

[11] Patent Number: 5,529,683

[45] Date of Patent: Jun. 25, 1996

[54] METHOD FOR PREVENTING DEGRADATION OF MEMBRANES USED IN ELECTROLYTIC OZONE PRODUCTION SYSTEMS DURING SYSTEM SHUTDOWN

[75] Inventors: Kurt M. Critz; Trent M. Molter, both of Enfield, Conn.

[73] Assignee: United Technologies Corp., Windsor Locks, Conn.

[21] Appl. No.: 407,279

[22] Filed: Mar. 20, 1995

[51] Int. Cl.[6] ..... C25B 15/00

[52] U.S. Cl. ..... 205/350; 205/347; 205/342

[58] Field of Search ..... 204/128, 129, 204/101, 98; 479/13, 30; 205/350, 347, 342, 626

[56] References Cited

U.S. PATENT DOCUMENTS

| | | | |
|---|---|---|---|
| 4,323,435 | 4/1982 | Carlin | 204/98 |
| 4,345,981 | 8/1982 | Bennett et al. | 204/129 |
| 4,416,747 | 11/1983 | Menth et al. | 204/129 |
| 4,539,083 | 9/1985 | Samejima et al. | 204/98 |
| 4,561,945 | 12/1985 | Coker et al. | 204/98 |
| 4,578,160 | 3/1986 | Asano et al. | 204/98 |
| 4,671,863 | 6/1987 | Tejeda | 204/101 |
| 4,690,739 | 9/1987 | Nott | 204/131 |
| 4,836,929 | 6/1989 | Baumann et al. | 210/638 |
| 5,203,972 | 4/1993 | Shimamune et al. | 204/129 |
| 5,290,406 | 3/1994 | Sawamoto et al. | 204/101 |

FOREIGN PATENT DOCUMENTS 63-055106 3/1988 Japan .

*Primary Examiner*—Kathryn Gorgos

*Attorney, Agent, or Firm*—Mary R. Bonzagni; Holland & Bonzagni

[57] ABSTRACT

Prevention of degradation of ion exchange membranes and/or system hardware in electrolytic systems, during system shutdown, is effected by applying a reverse potential to the electrolytic system during shutdown of operation.

4 Claims, 2 Drawing Sheets

METHOD FOR PREVENTING DEGRADATION OF MEMBRANES USED IN ELECTROLYTIC OZONE PRODUCTION SYSTEMS DURING SYSTEM SHUTDOWN

BACKGROUND OF THE INVENTION

1. Field of the Invention

The present invention generally relates to electrolytic systems that employ ion exchange membranes and fluids corrosive to such membranes and/or system hardware, and more specifically, to a method for preventing degradation of the membrane and/or hardware during system shutdown.

2. Description of Prior Art

Semiconductor production, biotechnology, and other applications require the use of ultrapure water. Such high-purity, pure water is achieved by water purification systems that subject feed water to treatments or techniques that target ionic and nonionic substances, in addition to, microorganisms, such as bacteria. Recent advances in ion exchange resin treatments or distillation techniques enable the near elimination of free ions in such high purity water. Remaining dead cells of microorganisms and nonionic substances are now treated with ozone, a powerful and clean oxidizing agent. The use of ozone for water treatment is particularly advantageous where no residual substances are left in the treated water, unlike chlorine-containing oxidizing agents. The lack of residual substances is due to the fact that the product of ozone decomposition is oxygen and water and to the fact that ozone is so unstable that it does not remain in treated water.

Where ozone is naturally unstable, it is necessary to generate it on site. The production of ozone on the industrial scale has taken place by means of corona-type electrical discharges in air or oxygen. However, existing corona discharge technology is often too expensive to implement or too difficult to maintain at various sites. As a result, alternate technologies, that allow for cost effective, on-site generation of ozone, have been sought.

Electrolytic systems or devices for ozone generation, which resemble standard solid polymer electrolyte electrolysis units, have proven to be one such viable alternative to conventional corona discharge systems. Such electrolytic systems have the advantage of being able to obtain a high concentration of high-purity ozone gas through use of one or more small-sized electrolytic cells. Unfortunately, a life problem associated with the presence of ozone in the system during system shutdown has been identified. In particular, physical deterioration of the ion exchange membrane employed, greatly increased (if not disabling) cell voltage requirements on system restart and resultant shortened or limited cell life has been observed.

It is, therefore, a principal object of the present invention to provide a method for preventing degradation or deterioration of ion exchange membranes and/or system hardware employed in electrolytic systems.

It is yet a further object of the present invention to provide a method for stabilizing cell voltage requirements on system restart and for prolonging cell life.

SUMMARY OF THE INVENTION

The present invention, therefore, provides a method for preventing deterioration of an ion exchange membrane and/or system hardware during shutdown of an electrolytic system or cell. Such cells have an anode material layer and a cathode material layer located contiguous to the membrane, employ or produce fluids that are reducible and that are corrosive to the membrane and/or the hardware used in the cell, and have an electric current applied in a positive direction between the anode and cathode material layers during operation. In particular, the present invention provides a method that comprises applying an electric current, in a negative direction, between the anode and cathode material layers of such cells, during shutdown, so as to reduce the corrosive fluids to a form that does not adversely affect the cell components.

DETAILED DESCRIPTION OF THE PREFERRED EMBODIMENT

Figure 1:
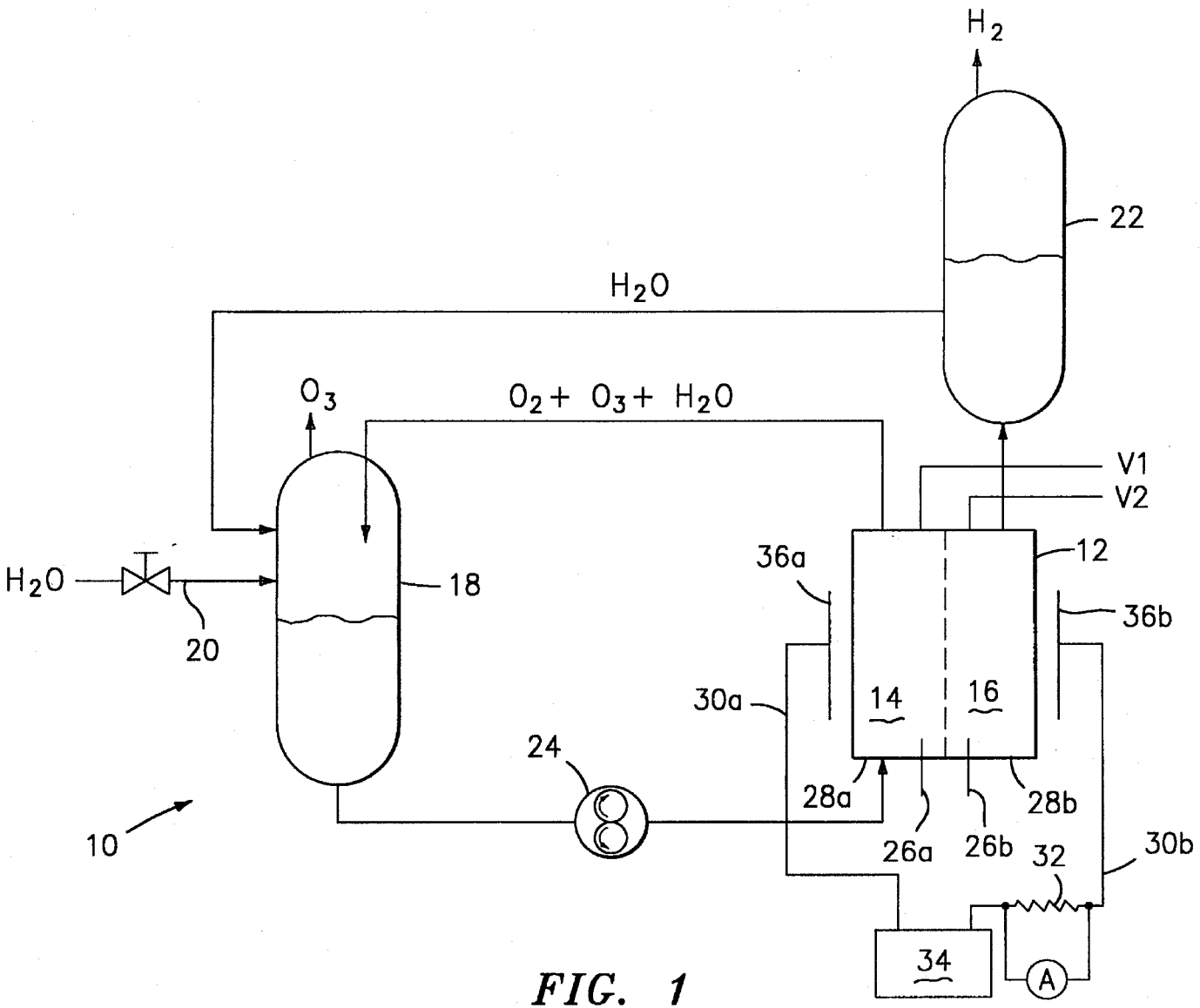
FIG. 1 shows a flowchart of an ozone generating test system for use with the present inventive method.

Although the present invention is described hereinbelow generally in association with ozone generating electrolytic systems or cells, the invention is not so limited. The inventive method can be utilized with any system that employs ion exchange membranes and reducible fluids that are corrosive to the membrane and/or to system hardware and that can be reduced to a less corrosive form. For example, this invention can be utilized with systems employing corrosive halogens such as chlorine, bromine, fluorine, and iodine. These systems include hydrogen-halogen fuel cells and hydrogen-halogen electrolyzers.

The term corrosive, as used herein, is intended to mean a gradual destruction of a material due to chemical processes such as oxidation.

The essence of the present invention is to prevent deterioration of membranes and hardware of electrolytic cells that is caused by the presence of corrosive fluids, such as ozone, in the membrane and in the atmosphere surrounding cell hardware, during shutdown.

Electrolytic cells for use with the present inventive method include ozone generating electrolytic cells having a structure of the type in which an ion exchange membrane is covered on one side with an anode material and on the other side with a cathode material. This composite structure serves to partition the cell into an anode fluids compartment, where ozone is generated, and into a cathode compartment, where hydrogen gas is generated.

The ion exchange membrane of such ozone generating electrolytic cells can be any membrane of a hydrophilic ion exchange resin capable of effectively transporting protons and water. Such membranes include perfluorinated membranes such as perfluorocarboxylic acid membranes and perfluorosulfonic acid membranes. Preferred ion exchange membranes are sold by E. I. Dupont De Nemours, Inc., Wilmington, Del., under the product designation NAFION® perfluorosulfonic acid membranes.

The anode material and cathode material covering the respective sides of the above-described ion exchange membrane are not particularly limited or restricted. The anode material may be α or β-lead dioxide or the like. It is preferred that the anode material be prepared by: mixing β-lead dioxide with from about 5 to about 30% by wt, and preferably with from about 10 to about 20% by wt., of a polytetrafluoroethylene (PTFE) polymer (e.g. TEFLON® PTFE polymer); and then bonding the resulting mixture to the membrane using heat and pressure. The cathode material may be a platinum group metal or an oxide thereof. Where platinum, ruthenium oxide, or the like is used, it is preferred that such materials also be mixed with from about 5 to about 30% by wt., and preferably with from about 10 to about 20% by wt., of TEFLON® PTFE polymer and that the resulting mixture be bonded to the membrane using heat and pressure.

The material for the anode fluids compartment in such electrolytic cells can be any material that possesses ozone resistance. Such materials include titanium, niobium, tantalum, stainless steel, etc.

Suitable materials for the cathode compartment also include titanium, zirconium, stainless steel, etc.

Preferred electrolysis conditions are as follows: current densities ranging up to about 2 amperes per square centimeter ($A/cm^2$); cell voltages ranging from about 2.5 to about 4.5 volts; and fluid temperatures ranging from about 21° C. to about 60° C. and more preferably from about 49° C. to about 54° C.

During operation of ozone generating electrolytic cells, having the above-described construction, pure water, ion-exchanged water (having a preferred resistivity of greater than 1 megohm-cm), or the like is introduced into the anode fluids compartment. Electricity is then applied to the anode material layer, which functions as the anode, and to the cathode material layer, which functions as the cathode.

Part of the water introduced into the fluids compartment is electrolytically oxidized at the surface of the anode material layer, by means of an anode reaction, to generate a mixture of ozone and oxygen. This mixture achieves a two phase gas-liquid mixture state and is then subjected to gas-liquid separation in an external tank or other separation device.

Hydrogen ions, produced as well as a result of the above-described anode reaction, migrate across the ion exchange membrane to the surface of the cathode material layer where they are electrolytically reduced to generate hydrogen gas.

The cell voltage requirements or overall thermal efficiency of such electrolytic cells is dependent upon the ion-exchange capacity, thickness and water content of the ion exchange membrane. It has been observed that upon restart of such cells cell voltage requirements are significantly increased, if not disablingly high, signifying that the cell and, in particular, the membrane has undergone noteworthy degradation during the preceding shutdown period.

As it relates to ozone-generating electrolytic cells, the present inventive method targets residual ozone as the agent or corrosive fluid responsible for the abovereferenced affects and, therefore, seeks to supply an atmosphere in the cell during shutdown that would cause this material to spontaneously decompose to oxygen and water; both of which do not adversely affect cell components. In particular, the present inventive method comprises applying a reverse potential to the cell during shutdown. It is preferred that a reverse potential be applied to the cell by: reversing the polarity on the cell; and applying an electric current at a voltage ranging from about 0.1 to about 1.5 volts and controlling or maintaining a current density up to about 50 milliamperes (mA)/$cm^2$, preferably from about 2 to about 10 $mA/cm^2$, for up to about 2 minutes, and preferably for about 30 seconds, upon cell shutdown. During shutdown the cell is operated at temperatures ranging from about 21° C. to about 60° C. and preferably from about 49° C. to about 54° C.

As a result of the application of a reverse potential to the cell, hydrogen gas, present in the cathode compartment, is electrolytically oxidized at the cathode material layer, to generate hydrogen ions that are then driven by the cell voltage across the membrane to the anode fluids compartment. These hydrogen ions react with ozone found in the membrane and in the fluids compartment to form oxygen and water.

As a result of the application of a reverse potential to a hydrogen-halogen fuel cell or to a hydrogen-halogen electrolyzer, hydrogen ions are driven to the halogen compartment of the cell thereby reducing the halogen to form a halogen acid. This halogen acid is typically less corrosive to cell electrodes and supporting hardware than is the molecular halogen material. This product acid can then be diluted and flushed away with process water to render it even less corrosive.

The present invention is described in more detail with reference to the following specific embodiment which is for the purpose of illustration only and is not to be understood as indicating or implying any limitations on the broad invention described herein.

SPECIFIC EMBODIMENT

A. Cell Assembly

A solid polymer electrolysis cell having an active area of 46.5 $cm^2$ was assembled as set forth below.

A layer of a cathode electrode having a 6 $mg/cm^2$ loading of platinum black was prepared by first mixing 236 mg of platinum black catalyst with 42 mg TEFLON® PTFE polymer and then milling the resulting catalyst/TEFLON® polymer mixture with 120 ml. powdered dry ice. The resulting material was allowed to sublimate on a tantalum sheet until the catalyst/TEFLON® polymer mixture was left in an even layer. This layer was then bonded to a perfluorocarbonsulfonic acid-type ion-exchange membrane, in the hydrogen ion form, (NAFION™ 117 membrane produced by DuPont), measuring 30.5 cm×43.2 cm, by using heat and pressure. In particular, the membrane and the layer of cathode electrode (positioned on the tantalum sheet) were placed on top of each other in a Hobbing Press hydraulic press (Model #14-200, available from Modern Hydraulic Press Co., Clifton, N.J.) between two tantalum foils. The press was heated to 177° C. and 980 KPa of pressure was then applied to the membrane by means of a piston plate, measuring 30.5 cm×43.2 cm, for 8 minutes. The press was then cooled to ambient temperature and the pressure released. (The membrane was die cut to a diameter of 10.2 cm, and had a thickness of 0.23 mm and an ion-exchange capacity of 0.92 meq/g.) A layer of an anode electrode having a 14 $mg/cm^2$ loading of β-lead dioxide was then prepared by first mixing 552 mg of β-lead dioxide catalyst with 98 mg TEFLON® polymer, and then proceeding as detailed above which included bonding the layer to an opposing surface of the membrane.

Six layers of 5/0 mesh titanium screen were then placed (free-standing) on each side of the prepared electrode structure (bonded to the membrane), with each screen layer having a thickness of 5 mils. The resulting assembly was then placed in a housing formed from a silicone rubber gasket placed around the perimeter of the screens and backed up by a titanium sheet. TEFLON® polymer gaskets were placed in between housing layers to effect a positive seal. The entire assembly was held together using tie rods, nuts and spring-washers.

B. Test System.

The resulting cell was placed in a test system 10 as shown in FIG. 1.

The system 10 was made up of cell 12, having anode chamber 14 and cathode chamber 16, TEFLON® PTFE polymer vessel 18 having water inlet port 20, TEFLON® polymer separator vessel 22, and gear pump 24. TEFLON® polymer vessel 18 and TEFLON® polymer separator vessel 22 were vented to the atmosphere for relief of generated gases. Type T, copper-constantan thermocouples 26*a,b* were placed in holes bored into endplates 28*a,b* of cell 12 and flexible silicone rubber-type electrical resistance heaters (available from Watlow Electric Mfg. Co., 12001 Lackland Road, St. Louis, Mo. 63146-4039) (not shown) were attached to cell endplates 28*a,b* using silicone cement. Cell temperature was controlled using an Omega® CN9121 Temperature Controller (available from Omega Engineering, Inc., One Omega Drive, Box 4047, Stamford, Conn. 06907-0047) (not shown).

C. Operation of Test System.

Distilled, deionized water was first charged into the system 10 through inlet port 20, then recirculated through the anode chamber 14 using gear pump 24 and passed into the TEFLON® polymer vessel 18 to facilitate separation of any gas from the flowing water. Water was passed through the anode chamber 14 at a constant rate of 150 cc/min. Electrical lead 30*a* was attached directly to a DC power supply 34 while electrical lead 30*b* was attached through a resistance shunt 32 to the power supply 34. The power supply 34 was set in a constant current mode and tuned to 25 amps (500 mA/cm$^2$). Cell voltage was applied through cell terminal plates 36*a,b* and measured at V1 and V2 while cell current was measured at the in-line resistance shunt 32. Cell voltage (i.e., the absolute value of V1 and V2) measured to be approximately 3 volts and fluid temperatures ranged from 49° C. to 54° C. Hydrogen generated at the cathode contained some water and was passed to TEFLON® polymer separator vessel 22. Ozone and oxygen were passed along with excess water from the anode chamber 14 to TEFLON® polymer vessel 18. Ozone generation was measured periodically by bubbling effluent obtained from TEFLON® polymer vessel 18 through a potassium iodide solution and then titrating this solution with 0.1N sodium thiosulfate.

EXAMPLE

In this example, the effect of employing the present inventive method on the cell voltage on test system 10 restart was tested. In particular, the cell 12 was shut down by first disconnecting the power supply 34 and terminating the water recirculated through the cell 12. The polarity on the cell 12 was then reversed and a current of 0.1–0.5 amps (2–10 mA/cm$^2$) was applied to the cell 12 at a voltage of approximately 0.1–1.5 volts. This was carried out for a period of approximately 1–2 minutes. The power supply 34 was then disconnected. After shutdown periods of 0.5 hr to several hours, the cell 12 was restarted. During the tenth cell shutdown, the present method was not employed. Instead, the cell 12 was shut down by disconnecting the power supply 34 and by terminating the water recirculated through the cell 12. Voltage measurements obtained on each restart of test system 10 are set forth in FIG. 2.

Figure 2:
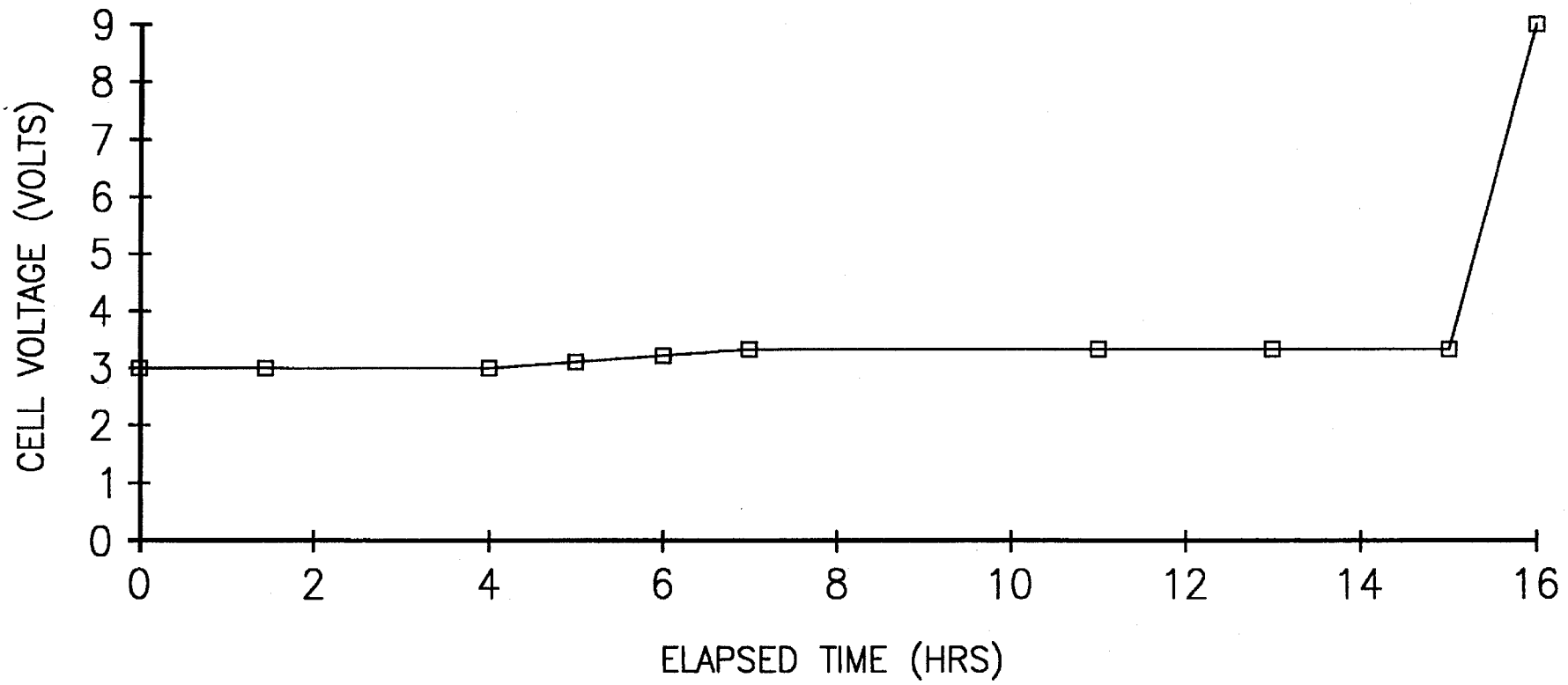
FIG. 2 shows a graph exhibiting cell voltages on restart of the test system shown in FIG. 1 which has employed the present inventive method and then has employed a standard cell or system shutdown procedure.

The test results shown in FIG. 2 indicate that the voltage on test system 10 restart was stable using the present inventive method and when this method was not used (see elapsed time=16 hrs.), the voltage climbed dramatically to the point where the cell 12 became inoperable. Disassembly after the cell 12 failed showed that the normally clear cell membrane turned milky near the active area.

Although this invention has been shown and described with respect to a detailed embodiment thereof, it would be understood by those skilled in the art that various changes in form and detail thereof may be made without departing from the spirit and scope of the present invention.

Having thus described the invention, what is claimed is:

1. A method for preventing deterioration of an ion exchange membrane of an ozone generating electrolytic cell, during shutdown of said cell, wherein said electrolytic cell is partitioned by said membrane into a fluids compartment, containing an anode material layer, where ozone is generated, and a cathode compartment, containing a cathode material layer, where hydrogen gas is generated, wherein an electric current is applied in a positive direction between said anode layer and said cathode layer during operation of said cell, and wherein said method comprises: applying an electric current in a negative direction between said anode layer and said cathode layer during shutdown to ionize said hydrogen gas to form hydrogen ions that pass across said membrane to said fluids compartment, wherein said hydrogen ions react with said ozone, present in said membrane and in said fluids compartment, to form oxygen and water.

2. The method of claim 1, wherein said ion exchange membrane is a perfluorinated ion exchange membrane.

3. The method of claim 1, wherein said ozone generating electrolytic cell is one of a plurality of electrolytic cells connected in series or in parallel.

4. The method of claim 1, wherein an electric current, at a voltage of from about 0.1 to about 1.5 volts, is applied in a negative direction between said anode layer and said cathode layer for a period up to about 2 minutes upon shutdown, and wherein during said period, said cell has a current density of from about 2 to about 50 mA/cm$^2$.

* * * * *